US011027574B2

(12) United States Patent
Grossenbacher et al.

(10) Patent No.: US 11,027,574 B2
(45) Date of Patent: Jun. 8, 2021

(54) PROCESS FOR THE PRODUCTION OF A TIMEPIECE PROVIDED WITH A RAISED EXTERNAL ELEMENT

(71) Applicant: The Swatch Group Research and Development Ltd, Marin (CH)

(72) Inventors: Pascal Grossenbacher, Neuchatel (CH); Stewes Bourban, Chabrey (CH); Pierry Vuille, Les Emibois (CH); Yves Winkler, Schmitten (CH)

(73) Assignee: The Swatch Group Research and Development Ltd, Marin (CH)

( * ) Notice: Subject to any disclaimer, the term of this patent is extended or adjusted under 35 U.S.C. 154(b) by 713 days.

(21) Appl. No.: 15/591,138

(22) Filed: May 10, 2017

(65) Prior Publication Data

US 2017/0334236 A1 Nov. 23, 2017

(30) Foreign Application Priority Data

May 19, 2016 (EP) ..... 16170378

(51) Int. Cl.
*G04D 3/00* (2006.01)
*G04B 19/18* (2006.01)
(Continued)

(52) U.S. Cl.
CPC ..... *B44C 1/14* (2013.01); *B44C 1/24* (2013.01); *C25D 1/10* (2013.01); *G04B 19/042* (2013.01);
(Continued)

(58) Field of Classification Search
CPC ..... B44C 1/14; G04B 19/10; G04B 19/18; G04B 45/00; G04B 37/22; C25D 1/003;
(Continued)

(56) References Cited

U.S. PATENT DOCUMENTS

2011/0203934 A1* 8/2011 Rey-Mermet ..... G03F 7/00 205/67
2011/0236580 A1* 9/2011 Winkler ..... B21J 1/006 427/282

(Continued)

FOREIGN PATENT DOCUMENTS

EP 2 380 864 A1 10/2011
EP 2 549 341 A1 1/2013

OTHER PUBLICATIONS

Frederik Ceyssens & Robert Puers, SU-8 Photoresist, Encyclopedia of Nanotechnology (Year: 2012).*

(Continued)

*Primary Examiner* — Moshe Wilensky
*Assistant Examiner* — Kyle A Cook
(74) *Attorney, Agent, or Firm* — Oblon, McClelland, Maier & Neustadt, L.L.P.

(57) ABSTRACT

The invention relates to a process for the production of a part provided with an external element comprising the following steps:

- provide an electrically conductive substrate having an upper surface and a pattern forming a recess in said upper surface
- deposit an electrically insulating layer into the pattern so that the insulating layer extends as far as the upper surface
- deposit a metal layer onto the upper surface of the substrate by galvanic growth so that at the end of this step the metal layer partly rests on the insulating layer
- dissolve the insulating layer
- cover an assembly comprising the substrate and the metal layer with a mass of a base material of the part, wherein the mass forms an imprint of the assembly (Continued)

separate the mass and the metal layer from the substrate, wherein the mass then exhibits an external element with a shape corresponding to the imprint of the pattern.

9 Claims, 3 Drawing Sheets

(51) Int. Cl.

| | |
|---|---|
| ***C25D 1/10*** | (2006.01) |
| ***A44C 27/00*** | (2006.01) |
| ***B44C 1/14*** | (2006.01) |
| ***G04B 19/10*** | (2006.01) |
| ***G04B 19/04*** | (2006.01) |
| ***G04B 45/00*** | (2006.01) |
| ***G04B 19/12*** | (2006.01) |
| ***G04B 19/28*** | (2006.01) |
| ***B44C 1/24*** | (2006.01) |

(52) U.S. Cl.
CPC ..... *G04B 19/10* (2013.01); *G04B 19/12* (2013.01); *G04B 19/18* (2013.01); *G04B 19/28* (2013.01); *G04B 45/00* (2013.01); *G04D 3/0048* (2013.01); *A44C 27/00* (2013.01)

(58) Field of Classification Search
CPC . C25D 1/10; C25D 7/005; C25D 5/00; G04D 3/0048; A44C 27/00; C23C 18/1633; C23C 18/1635; C23C 18/1637; C23C 18/1639
See application file for complete search history.

(56) References Cited

U.S. PATENT DOCUMENTS

| | | | | |
|---|---|---|---|---|
| 2011/0259753 | A1 | 10/2011 | Grossenbacher et al. | |
| 2014/0177401 | A1 | 6/2014 | Grossenbacher et al. | |
| 2016/0179000 | A1* | 6/2016 | Calame ..... | B81C 99/008 430/320 |
| 2017/0362728 | A1* | 12/2017 | Abe ..... | C25D 1/20 |

OTHER PUBLICATIONS

European Search Report dated Oct. 28, 2016 in European Application 16170378, filed on May 19, 2016 ( with English translation of Categories of Cited Documents).

* cited by examiner

PROCESS FOR THE PRODUCTION OF A TIMEPIECE PROVIDED WITH A RAISED EXTERNAL ELEMENT

This application claims priority from European Patent Application No. 16170378.0 filed on May 19, 2016, the entire disclosure of which is hereby incorporated herein by reference.

FIELD OF THE INVENTION

The invention relates to a process for the production of a part such as a timepiece or item of jewellery, e.g. a watch dial, bezel, band or bracelet etc. More specifically, the process enables an external element such as an hour indicator, a decorative element etc. to be made on said part.

BACKGROUND OF THE INVENTION

In the field of clock-making or jewellery making it is classic practice to make raised external elements of a different colour to that of the support of said elements. In particular, patent application EP 2192454A1 is known from the prior art, which describes a process for the production of a raised external element on a dial. According to the third embodiment described in this application a watch dial having T-shaped through openings is made. A mask is then attached onto the dial. The mask has openings arranged so as to connect with the openings of the dial. The openings are then filled by means of electroplating, by pressing an amorphous material or by injecting metal in order to form external elements. Finally, the excess thickness of filling material of the mask is removed and the mask is taken off.

A disadvantage of this process is that it does not enable external elements formed in one piece with the dial to be made, as the dial is covered with a layer of a different colour in order to produce the desired two-coloured appearance. Another disadvantage is the restriction in shape of the external elements. For example, the process does not allow the production of external elements that are raised above the dial, i.e. elements having an inside face (the face pointing towards the dial) that is not pressed fully against the dial, i.e. external elements that have a head at the top of a narrower part, the narrow part being joined to the dial. Another disadvantage is that the process does not allow the production of external elements with heads that are textured, e.g. engine turned. Another disadvantage is that the process does not allow the production of external elements that are formed from a non-metallic material.

SUMMARY OF THE INVENTION

The aim of the present invention is to fully or partly overcome the disadvantages discussed above.

For this purpose, according to a first embodiment the invention relates to a process for the production of a part provided with an external element comprising the following steps:

- provide an electrically conductive substrate having an upper surface and a pattern forming a recess in said upper surface
- deposit an electrically insulating layer into the pattern so that the insulating layer extends as far as the upper surface
- deposit a metal layer onto the upper surface of the substrate by galvanic growth so that at the end of this step the metal layer partly rests on the insulating layer

- dissolve the insulating layer
- cover an assembly comprising the substrate and the metal layer with a mass of a base material of the part, wherein the mass forms an imprint of the assembly
- separate the mass and the metal layer from the substrate, wherein the mass then exhibits an external element with a shape corresponding to the imprint of the pattern.

According to the first embodiment the process enables the production of a part provided with a raised external element. This external element is formed from the portion of the mass filling the pattern at the end of the covering step, and it is thus impossible to separate the external element from the part. Moreover, since the external element corresponds in shape to the imprint of the pattern, it is clear that the recess can take any desired shape. Moreover, the external element has the colour of the base material of the part, and this forms a contrast with the colour of the metal layer arranged around the external element. Finally, as a result of the imprint the textures of the upper surface and the base of the pattern are transferred onto the metal layer and the head of the external element.

According to a second embodiment the invention relates to a process for the production of a part provided with an external element comprising the following steps:

- provide an electrically conductive substrate having an upper surface and a pattern forming a recess in said upper surface
- deposit an electrically insulating layer into the pattern so that the insulating layer extends as far as the upper surface
- deposit a metal intermediate layer onto the upper surface of the substrate by galvanic growth so that at the end of this step the intermediate layer partly rests on the insulating layer
- deposit a metal layer onto the intermediate layer by galvanic growth
- dissolve the insulating layer
- cover an assembly comprising the substrate, the intermediate layer and the metal layer with a mass of a base material of the part, wherein the mass forms an imprint of the assembly
- separate the mass, the intermediate layer and the metal layer from the substrate, wherein the mass then exhibits an external element with a shape corresponding to the imprint of the pattern
- dissolve the intermediate layer.

The part formed using the process according to the second embodiment differs from the part formed by the process according to the first embodiment in that the external element protrudes, i.e. is raised, in relation to the metal layer. In the second embodiment the metal layer is curved around the external element. Thus, the periphery of the lower face of the external element rests on the metal layer in the first embodiment, which is not the case in the second embodiment. This all gives the two parts different aesthetic appearances.

In addition, the production process according to the first or second embodiment can comprise one or more of the following features in all technically possible combinations.

In a non-restrictive embodiment the process according to the first or second embodiment includes the following step:

- dissolve the metal layer.

In a non-restrictive embodiment the process according to the first or second embodiment includes the following step implemented before the step of depositing the insulating layer:

machine the upper surface of the substrate so as to create a texture, e.g. an engravment.

In a non-restrictive embodiment of the process according to the first or second embodiment the pattern has a base that has a texture, e.g. an engravment.

In a non-restrictive embodiment the process according to the first or second embodiment includes the following step implemented after the step of depositing the metal layer:

machine the metal layer so as to reduce its thickness.

In a non-restrictive embodiment of the process according to the first or second embodiment the base material is an amorphous metal or a polymer, and the covering step is performed by pressing a block of base material onto the assembly comprising the substrate and the metal layer.

In a non-restrictive embodiment of the process according to the first or second embodiment the base material is metallic, and the covering step is performed by galvanic growth of the base material on the assembly comprising the substrate and the metal layer.

In a non-restrictive embodiment of the process according to the first or second embodiment the metal layer is formed from gold, silver or nickel.

In a non-restrictive embodiment of the process according to the first or second embodiment the insulating layer is formed from resin.

BRIEF DESCRIPTION OF THE DRAWINGS

Other special features and advantages will become clear from the following non-restrictive description provided as an example with reference to the attached drawings, wherein.

DETAILED DESCRIPTION OF THE PREFERRED EMBODIMENTS

According to a first embodiment illustrated in FIGS. 1*a* to 1*f* the process according to the invention comprises the following steps.

Figure 1A:
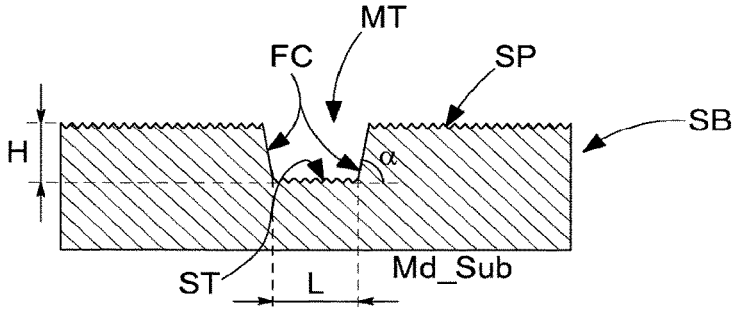
FIGS. 1*a* to 1*f* are schematic representations of steps of the process for the production of a part provided with an external element according to a first embodiment of the invention.

According to a step Md_Sub shown in FIG. 1*a*, an electrically conductive substrate SB, also called a master in the field of moulding, is provided. The substrate SB is advantageously formed from brass, but can be formed from another material, e.g. stainless steel, aluminium, nickel, a cermet composite, a ceramic or a polymer that has been rendered conductive (by electroplating or plasma treatment, for example) etc. Moreover, the substrate SB has a hollow pattern MT opening onto an upper surface SP of the substrate SB. In one embodiment the pattern MT has been created by machining the substrate SB.

In the example of FIG. 1*a* the pattern MT has a flat base ST extending parallel to the upper surface SP of the substrate SB and flanks FC extending substantially orthogonally to said base ST, but this form is not restrictive. The flanks FC could be inclined in relation to the upper surface SP at an angle $\alpha$ less than 90°, the base ST could be not fully parallel to the upper surface SP etc.

It is noted that the upper surface SP of the substrate SB and the base ST of the pattern MT have possibly undergone a surface machining operation to create a particular texture that is desired for the part, e.g. an engraving, as can be seen in FIG. 1*a*.

Figure 1B:
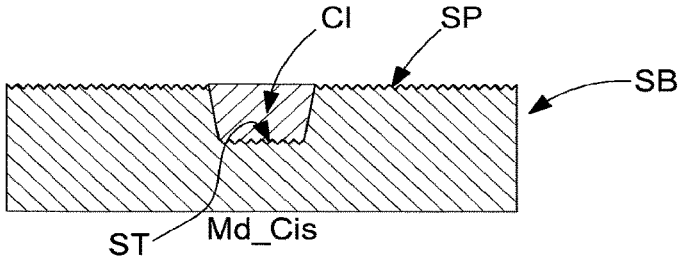

According to a step Md_Cis shown in FIG. 1*b*, an insulating layer CI, advantageously a resin, is deposited into the pattern MT to the level of the upper surface SP. The depositing step Md_Cis is performed, for example, by stoving a resin in viscous form deposited into the pattern MT. In practice, if the insulating layer CI is deposited to a thickness E that causes the insulating layer CI to extend beyond the upper surface SP of the substrate SB, the excess is removed by surface treatment. This surface treatment may also enable a texture to be created or recreated at the level of the upper surface SP.

Figure 1C:
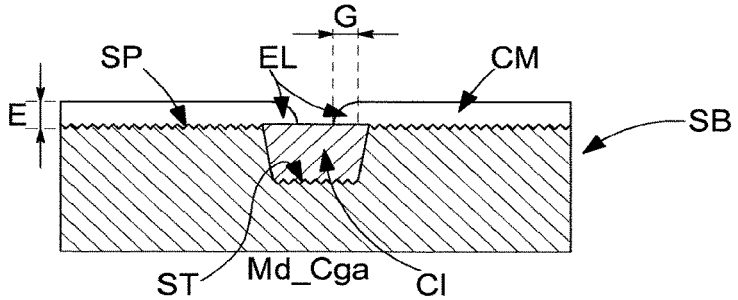

According to a step Md_Cga shown in FIG. 1*c*, a metal layer CM is deposited onto the (electrically conductive) upper surface SP of the substrate SB by galvanic growth. The substrate SB and the insulating layer CI are thus dipped into a galvanic bath suitable for the deposition of a metal such as gold, silver, nickel or any other metal or metal alloy that can be deposited in a relatively thick layer. Because of the configuration of the insulating layer CI in relation to the substrate SB, the metal deposit grows not only orthogonally to the upper surface SP, but also laterally, i.e. in the direction of the insulating layer CI. At the end of step Md_Cga the metal layer CM thus has lateral ends EL that rest on the insulating layer CI.

According to an optional step, the metal layer CM is machined to reduce its thickness E and/or structure or polish its surface.

Figure 1D:
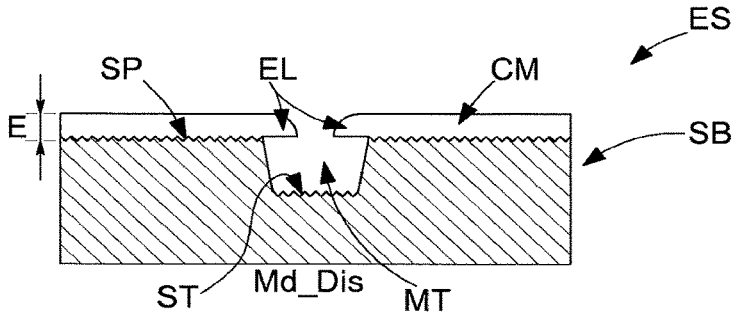

According to a step Md_Dis shown in FIG. 1*d*, the insulating layer CI is dissolved. Thus, all that remains is an assembly ES formed from the substrate SB and the metal layer CM.

According to an optional step, a surface treatment of this assembly ES is conducted. This treatment is the application of a parting agent or a passivation treatment, for example. The significance of this step will be seen in the following text.

Figure 1E:
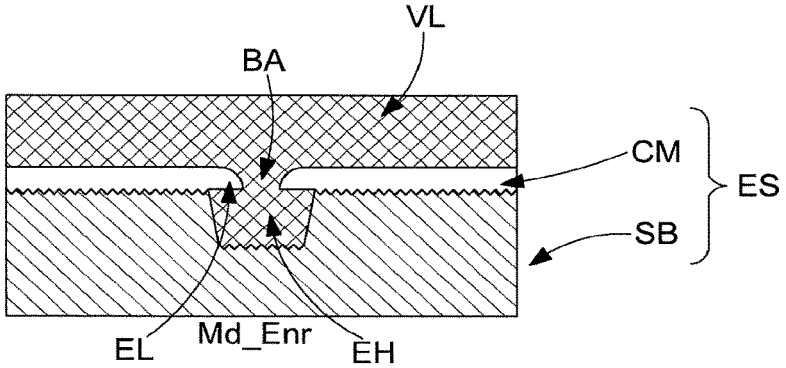

In a step Md_Enr shown in FIG. 1*e*, this assembly ES is covered with a mass VL of a base material of the part to be produced so that the mass VL forms an imprint of the assembly ES. In one embodiment the base material consists of amorphous or partly amorphous metal, which is of interest because of its mechanical properties. In another embodiment the base material is a polymer. In these two cases a block of amorphous or partly amorphous metal or polymer is pressed onto the assembly ES at a temperature, at which it has a paste-like consistency, which enables it to deform to mould to the shapes of the assembly ES, and in particular to those of the metal layer CM and the pattern MT. In another embodiment the base material is any other metal or metal alloy, e.g. nickel, gold etc., and the covering is conducted by galvanic growth of said metal. It is noted that at the end of step Md_Enr the mass VL of base material has a portion EH corresponding in form to the imprint of the pattern MT as well as a narrow portion BA corresponding to the filling of the space between the lateral ends EL of the metal layer CM.

Figure 1F:
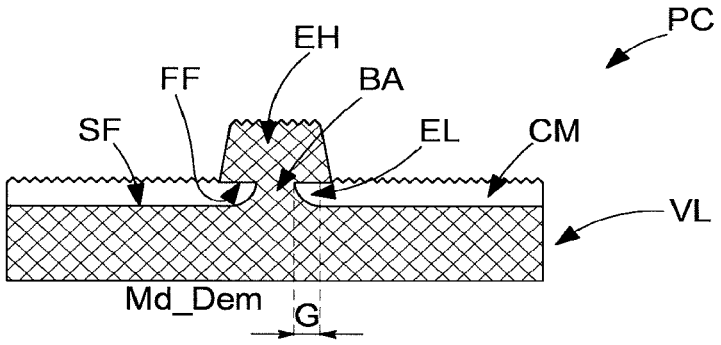

According to a step Md_Dem shown in FIG. 1*f*, the mass VL of base material and the metal layer CM are separated from the substrate SB. To achieve this, the substrate SB is dipped into a selective acid bath, for example, in which it is dissolved. Alternatively, the separation is achieved by forcible demoulding. Demoulding is thus facilitated if the assembly ES has been surface treated beforehand.

At the end of step Md_Dem the mass VL of base material exhibits a raised external element EH that corresponds in shape to the imprint of the pattern MT and has an upper face SF covered with the metal layer CM. The metal layer CM extends on both sides of the narrow portion BA between the upper face SF of the mass VL and a lower face FF of the external element EH. It is noted that the entire lower face FF of the external element EH is in contact with the metal layer CM: the lower face FF of the external element is situated in the extension of the upper surface of the metal layer CM.

According to a second embodiment illustrated in FIGS. 2*a* to 2*e*, the process according to the invention comprises steps Md_Sub to Md_Cis described above followed by the following steps.

Figure 2A:
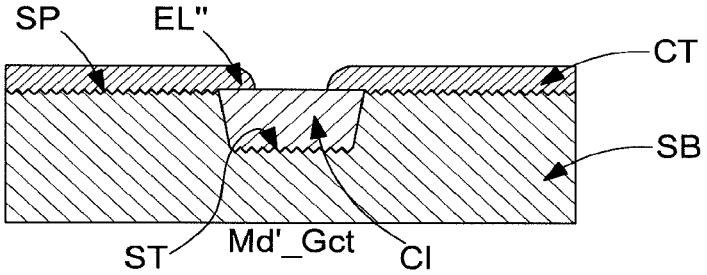
FIGS. 2*a* to 2*f* are schematic representations of steps of the process for the production of a part provided with an external element according to a second embodiment of the invention.

According to a step Md'_Gct shown in FIG. 2*a*, a metallic intermediate layer CT is deposited onto the (metallic) upper surface SP of the substrate SB by galvanic growth. The substrate SB and the insulating layer CI are thus dipped into a galvanic bath suitable for the deposition of a metal such as nickel. Because of the configuration of the insulating layer CI in relation to the substrate SB, the metal deposit grows not only orthogonally to the upper surface SP, but also laterally, i.e. in the direction of the insulating layer CI. At the end of step Md_Gct the intermediate layer CT thus has lateral ends EL" that rest on the insulating layer CI.

Figure 2B:
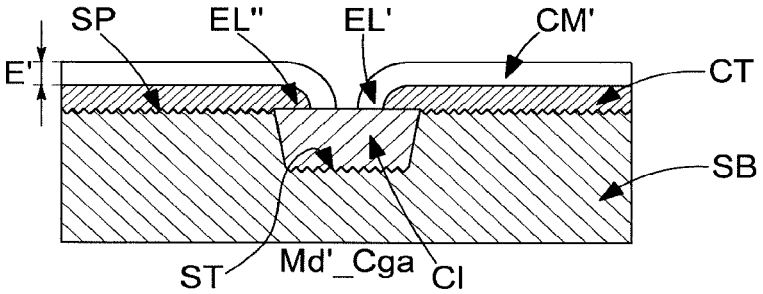

According to a step Md'_Cga shown in FIG. 2*b*, a metal layer CM' is deposited onto the (metallic) intermediate layer CT by galvanic growth. The metal is gold or silver, for example, but can be any other metal or metal alloy that can be deposited in a relatively thick layer. At the end of step Md'_Cga the metal layer CM' covers the intermediate layer CT. The metal layer CM' thus has lateral ends EL' that cover the lateral ends EL" of the intermediate layer CT and that rest on the insulating layer CI.

According to an optional step, the metal layer CM' is machined to reduce its thickness E' and/or structure or polish its surface.

Figure 2C:
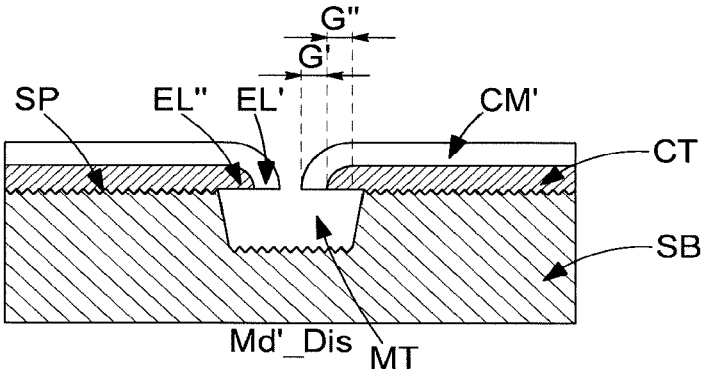

According to a step Md'_Dis shown in FIG. 2*c*, the insulating layer CI is dissolved. Thus, all that remains is an assembly ES' formed from the substrate SB, the intermediate layer CT and the metal layer CM'.

According to an optional step, a surface treatment of this assembly ES' is conducted. This treatment is the application of an oil or a passivation, for example. The significance of this step will be seen in the following text.

Figure 2D:
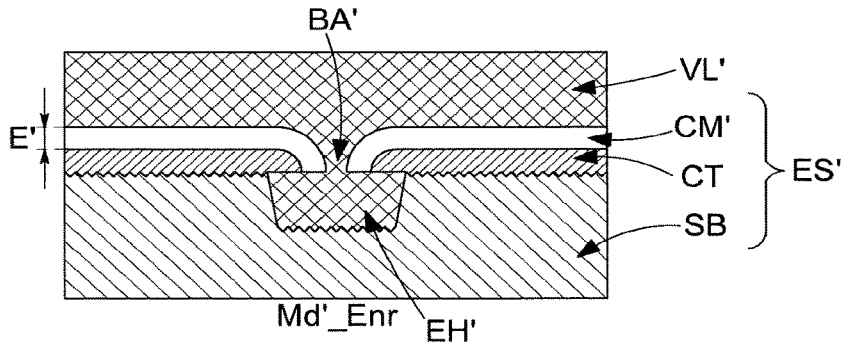

In a step Md'_Enr shown in FIG. 2*d*, the assembly ES' is covered with a mass VL' of a base material of the part to be produced so that the mass VL forms an imprint of the assembly ES. In one embodiment the base material consists of amorphous metal, which is of interest because of its mechanical properties. In another embodiment the base material is a polymer. In these two cases a block of amorphous or partially amorphous metal or polymer is pressed onto the assembly ES' at a temperature, at which it has a paste-like consistency, which enables it to deform to mould to the shapes of the assembly ES', and in particular to that of the pattern MT. In another embodiment the base material is any other metal, e.g. nickel, gold etc., and the covering is conducted by galvanic growth of said metal. It is noted that at the end of step Md'_Enr the mass VL' of base material has a portion EH' corresponding in form to the imprint of the pattern MT as well as a narrow portion BA' corresponding to the filling of the space between the lateral ends EL' of the metal layer CM'.

Figure 2E:
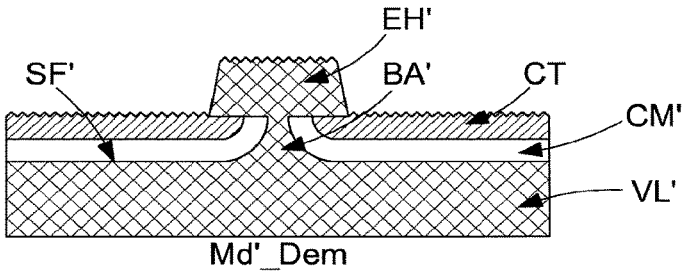

According to a step Md'_Dem shown in FIG. 2*e*, the mass VL' of base material, the intermediate layer CT and the metal layer CM' are separated from the substrate SB. To achieve this, the substrate SB is dipped into a selective acid bath, for example, in which it is dissolved. Alternatively, the separation is achieved by forcible demoulding. Demoulding is thus facilitated if the assembly ES' has been surface treated beforehand.

Figure 2F:
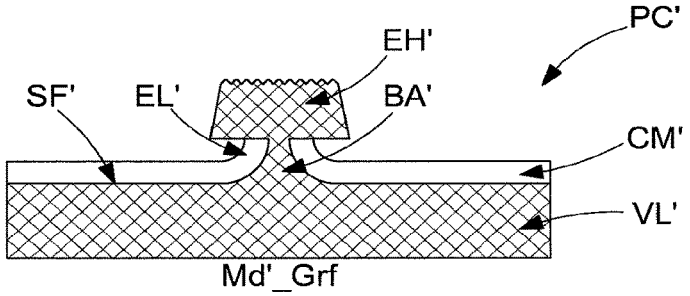

According to a step Md'_Grf shown in FIG. 2*f*, the intermediate layer CT is dissolved. The mass VL' of base material thus shows a raised external element EH' that corresponds in shape to the imprint of the pattern MT and has an upper face SF' covered with the metal layer CM'. The metal layer CM' extends on both sides of the narrow portion BA moulding to the curved shape of said narrow portion BA. Only a part of the lower face FF of the external element EH' is in contact with the metal layer CM': contrary to the case in the first embodiment.

Thus, the first and the second embodiment enable a two-coloured part PC, PC' comprising a raised external element EH, EH' to be produced, wherein the colour transition between the base material and the metal layer CM, CM' is sharply defined. Naturally, the external element EH, EH' cannot separate from the rest of the part PC, PC', since it is an integral part of the mass VL, VL' of base material. Moreover, it is reminded that the upper surface SP of the substrate SB and the base ST of the pattern MT may have previously undergone a surface machining operation to create a particular texture, e.g. an engraving. In this case, because of the imprint the metal layer CM, CM' and the head of the external element EH, EH' also have this texture.

Figure 3:
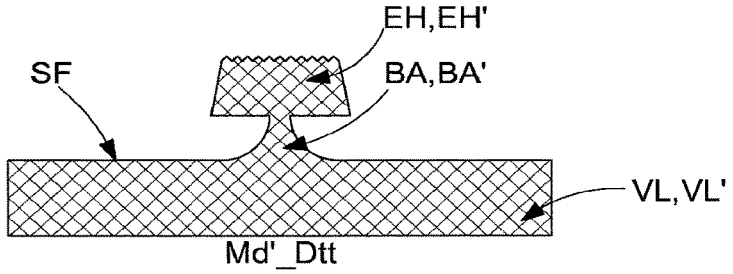
FIG. 3 is a schematic representation of an optional additional step of the process according to the first or the second embodiment of the invention.

According to an additional optional step Md_Dtt shown in FIG. 3, the metal layer CM, CM' is possibly dissolved. The narrow portion BA, BA' is then visible from the outside, providing a different aesthetic appearance.

The geometry of the external element EH, EH' and the narrow part BA, BA' depends on several parameters:

- the width L of the pattern MT shown in FIG. 1*a*
- the height H of the pattern MT shown in FIG. 1*a*
- the inclination a of the flanks FC of the pattern MT shown in FIG. 1*a*
- the width G, G' of the lateral ends EL, EL' of the metal layer CM, CM' shown in FIGS. 1*c* and 2*c*
- The width G" of the lateral ends EL" of the intermediate layer CT shown in FIG. 2*c*
- the thickness P, P' of said lateral ends EL, EL' of the metal layer CM, CM' (which is equal to their width G, G' unless the metal layer CM, CM' has been machined) shown in FIGS. 1*c* and 2*b*
- the thickness E, E' of the insulating layer CI, CI' deposited in step Md_Cis or Md'_Cis shown in FIGS. 1*b* and 2*b*.

Of course, the present invention is not limited to the illustrated example, but is open to various variants and modifications that will occur to the person skilled in the art.

What is claimed is:

1. A process for the production of a part of a timepiece or a jewelry provided with an external element comprising:

- forming an electrically conductive substrate having an upper surface and a lower surface;
- forming a pattern having a recess within the substrate between the upper surface and the lower surface;
- depositing an electrically insulating layer into the recess so that an upper surface of the insulating layer extends only as far as the upper surface of the substrate;

depositing a metal layer onto the upper surface of the substrate by galvanic growth so that a bottom surface of the metal layer covers only a portion of the upper surface of the insulating layer;

dissolving the insulating layer;

covering an assembly comprising the substrate and the metal layer with a mass of a base material of the part, wherein the mass forms an imprint of the pattern; and separating the mass and the metal layer from the substrate, wherein the mass then exhibits an external element with a shape corresponding to the imprint of the pattern.

2. The production process according to claim 1 further comprising:

dissolving the metal layer.

3. The production process according to claim 1 further comprising:

before the step of depositing the insulating layer, machining the upper surface of the substrate so as to create a texture.

4. The production process according to claim 1, wherein the pattern has a base that has a texture.

5. The production process according to claim 1 further comprising:

after the step of depositing the metal layer, machining the metal layer so as to reduce its a thickness of the metal layer.

6. The production process according to claim 1, wherein the base material is an amorphous metal or a polymer, and the covering is performed by pressing a block of base material onto the assembly comprising the substrate and the metal layer.

7. The production process according to claim 1, wherein the base material is metallic, and the covering is performed by galvanic growth of the base material on the assembly comprising the substrate and the metal layer.

8. The production process according to claim 1, wherein the metal layer is formed from gold, silver or nickel.

9. The production process according to claim 1, wherein the insulating layer is formed from resin.

* * * * *